US006362810B1

(12) United States Patent
Matsuda

(10) Patent No.: US 6,362,810 B1
(45) Date of Patent: Mar. 26, 2002

(54) TILTABLE JOYSTICK POINTING DEVICE

(75) Inventor: Teruo Matsuda, Urawa (JP)

(73) Assignee: Seimitsu Kogyo Kabushiki Kaisha, Toda (JP)

( * ) Notice: Subject to any disclaimer, the term of this patent is extended or adjusted under 35 U.S.C. 154(b) by 0 days.

(21) Appl. No.: 09/239,824

(22) Filed: Jan. 29, 1999

(30) Foreign Application Priority Data

Apr. 15, 1998 (JP) ..... 10-122938
Dec. 10, 1998 (JP) ..... 10-351700

(51) Int. Cl.[7] ..... G09G 5/08
(52) U.S. Cl. ..... 345/161
(58) Field of Search ..... 345/161, 163, 345/156; 200/5; 463/341

(56) References Cited

U.S. PATENT DOCUMENTS 5,140,313 A * 8/1992 Wen ..... 345/161
5,675,359 A * 10/1997 Anderson ..... 345/161
5,823,057 A * 10/1998 Hsien ..... 345/161
5,963,196 A * 10/1999 Nishiumi et al. ..... 345/161
5,973,471 A * 10/1999 Miura et al. ..... 345/161
5,986,645 A * 11/1999 Brooks ..... 345/161
6,002,388 A * 12/1999 Seffernick et al. ..... 345/161
6,064,369 A * 5/2000 Okabe et al. ..... 345/161

FOREIGN PATENT DOCUMENTS

JP 10-351700 12/1998

* cited by examiner

*Primary Examiner*—Richard Hjerpe
*Assistant Examiner*—Ronald Laneau
(74) *Attorney, Agent, or Firm*—Armstrong, Westerman & Hattori, LLP

(57) ABSTRACT

The joystick assembly of the tiltable joystick pointing device comprises a first shaft which is pivotally supported by the base and urged by the first spring assembly into the upright neutral position, a second shaft slidably guided relative to the first shaft so as to be slidable in an axial direction, a second spring assembly for axially urging the second shaft toward an axially neutral position, and a slide direction detector for producing a slide direction signal corresponding to an axial movement of the second shaft. Thus, by holding the second shaft and tilting the first shaft via the second shaft, a corresponding tilt direction signal is produced from the tilt direction detector in a conventional manner. Additionally, by holding the second shaft and pushing down or pulling down the second shaft relative to the first shaft, a corresponding slide direction signal is produced from the slide direction detector. Thus, by holding the second shaft with a single hand, it is possible to produce both a tilt direction signal and a slide direction signal at will.

12 Claims, 12 Drawing Sheets

TILTABLE JOYSTICK POINTING DEVICE

TECHNICAL FIELD

The present invention relates to a tiltable joystick pointing device which is suitable for use as a pointing device for video games based on three-dimensional display of objects, and in particular to such a tiltable joystick pointing device which is capable of producing more diverse detector signal contents than was hitherto possible by adding a pull-up and push-down action to the tiltable joystick pointing device.

BACKGROUND OF THE INVENTION

The contents of the output signal of a conventional tiltable joystick pointing device were strictly two-dimensional, and the pointing directions were confined to a plane perpendicular to the axial line of the joystick. In other words, only the forward, rearward, right, left and oblique directions in a single plane could be indicated by the joystick pointing device. Therefore, when such a pointing device was applied to a video game including three-dimensional display of objects, it was necessary to use a push-button pointing device in combination. The two-dimensional movement of an object can be associated with the corresponding movement of the joystick. The depth-wise movement of an object with respect to the plane of the display device can be associated with the pressing of the pushbutton. Therefore, the user has to use his both hands for individually operating the two different pointing devices, and this has been perceived as quite inconvenient.

To overcome such a problem, it is conceivable to add a push-down and pull-up action to the joystick. This in effect integrally combines a pushbutton pointing device with a joystick pointing device, and would enhance the convenience of the joystick pointing device, allowing the user to operate the device with a single hand.

Typically, the joystick of a joystick pointing device consists of a stick member which is pivotally supported by a mounting base at an intermediate part thereof via a spherical joint, and is normally urged to its upright neutral position by a coil spring coaxially fitted onto the stick member. A plurality of micro-switches are installed in a lower part of the mounting base, around the joystick member, so as to form a tilt direction detector. Selected one or two of the micro-switches are actuated depending on the tilting direction of the joystick member, and a corresponding multi-bit detector signal is produced from the micro-switches.

In such a conventional tiltable joystick pointing device, to allow the joystick member to be axially moveable, it is conceivable to support the spherical joint in an axially moveable manner over a prescribed stroke. However, such an arrangement necessarily requires to keep the relative position between the joystick member and the micro-switches forming the tilt direction detector. This can be accomplished by moving the micro-switches integrally with the joystick member or by providing two sets of micro-switches which are vertically spaced from each other so that the micro-switches may be operated by the joystick member at both the pulled-up and pushed-down positions thereof. In either case, the structure becomes substantially complex, and a significant number of component parts are required so that the cost significantly increases.

BRIEF SUMMARY OF THE INVENTION

In view of such problems of the prior art, a primary object of the present invention is to provide a tiltable joystick pointing device which additionally incorporates a push-down and pull-up action without substantially increasing the complexity of the device.

A second object of the present invention is to provide a tiltable joystick pointing device which is capable of producing an output signal of more versatile contents than was possible with a conventional device.

A third object of the present invention is to provide such a tiltable joystick pointing device which is both economical and durable.

According to the present invention, these and other objects can be accomplished by providing a tiltable joystick pointing device, comprising: a joystick assembly pivotally supported by a base; a first spring assembly for urging the joystick assembly toward an upright neutral position; a tilt direction detector for producing a tilt direction signal corresponding to a tilt direction of the joystick assembly; wherein the joystick assembly comprises a first shaft which is pivotally supported by the base and urged by the first spring assembly into the upright neutral position, a second shaft slidably guided relative to the first shaft so as to be slidable in an axial direction, a second spring assembly for axially urging the second shaft toward an axially neutral position, and a slide direction detector for producing a slide direction signal corresponding to an axial movement of the second shaft.

Thus, by holding the second shaft and tilting the first shaft via the second shaft, a corresponding tilt direction signal is produced from the tilt direction detector in a conventional manner. Additionally, by holding the second shaft and pushing down or pulling down the second shaft relative to the first shaft, a corresponding slide direction signal is produced from the slide direction detector. Thus, by holding the second shaft with a single hand, it is possible to produce both a tilt direction signal and a slide direction signal at will. Furthermore, because the pushing down and pulling up movement of the second shaft is effected while the first shaft is kept stationary with respect to the axial direction, the axial movement of the second shaft would not affect the relative position between the first shaft and the tilt direction detector. Thus, the tilt direction signal can be obtained in a both accurate and reliable manner in spite of the added function of the joystick assembly to produce the slide direction signal. Such push-down and pull-up movements of the second shaft can be conveniently achieved if the upper end of the second shaft extends out of an upper end of the first shaft and carries a knob such as a ball knob thereon.

According to a preferred embodiment of the present invention, the first shaft comprises a hollow tubular member, and the second shaft is slidably received inside the first shaft. Thus, the sliding movement of the second shaft can be accomplished in a both reliable and aesthetically satisfactory manner. To improve the external appearance of the joystick device, a tubular shaft cover may be coaxially attached to the second shaft so as to cover at least an upper end of the first shaft. The length of the shaft cover may be freely selected as desired, and can be used to hide the first shaft from view in any possible arrangement of the first shaft and the second shaft. However, it is particularly favorable when the shaft cover is used to hide the upper end of the first shaft, without regard to the relative position of the second shaft, which telescopically receives the second shaft.

The tilt direction detector can be selected from any known arrangements. It may comprise a plurality of switch elements mounted on a switch mounting plate which is interposed between a lower end of the base and a tilt guide plate.

It is also possible to separate the tilt movement of the joystick assembly or the first shaft into rotary movements around two mutually perpendicular axial lines, and produce the desired tilt direction signal from rotary potentiometers, rotary encoders or the likes which can detect such rotary movements.

The switch elements are typically provided with terminal pins which are required to be soldered to a circuit board. In view of the production efficiency and the production cost, it is desirable to eliminate the need to perform such a soldering step during the assembly process, and to allow the soldering step to be performed only after the assembly process is substantially completed. This can be achieved if the tilt direction detector comprises a plurality of switch elements mounted on a tilt guide plate attached to a lower end of the base, and an annular circuit board surrounding the tilt guide plate and having holes for receiving terminal pins extending from the switch elements.

The slide direction detector should be adapted to produce a slide direction detector signal when an axial movement of the second shaft relative to the first shaft exceeds a prescribed stroke in either axial slide direction. For instance, the slide direction detector may comprise a switch holder attached to a lower end of the first shaft, a switch element mounted on the switch holder, and a shaft end member attached to a lower end of the second shaft, the shaft end member being provided with an actuating projection with engages an actuating part of the switch element in response to an axial movement of the second shaft relative to the first shaft. This allows the detection of the axial movement of the second shaft relative to the first shaft without interfering with the tilt movement of the first shaft or the detection of the tilt direction of the first shaft. To accomplish this goal, it is also desirable to keep the second shaft rotationary fast with respect to the first shaft. It can be accomplished in a simple manner if the shaft end member further comprises a stopper arm extending therefrom which is engaged by a vertical guide slot defined in the switch holder for maintaining the second shaft rotationally fast with respect to the first shaft around an axial line thereof.

To produce an accurate and appropriate axial urging force for the second shaft, it is desirable to provide a dedicated spring assembly to produce a well defined spring force instead of relying on the spring force of the return spring of the switch element. Such a spring assembly should be compact enough to be accommodated in a limited space inside the base. Based on such a recognition, the slide direction detector may further comprise an upper spring member compressed between the switch holder and an upper end of the shaft end member so as to urge the second shaft downward with respect to the first shaft, and a lower spring member compressed between a lower end surface of the shaft member and a spring retaining member extending integrally from the switch holder so as to urge the second shaft upward with respect to the first shaft, the second shaft being balanced at a axially neutral position under spring forces of the upper and lower springs.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
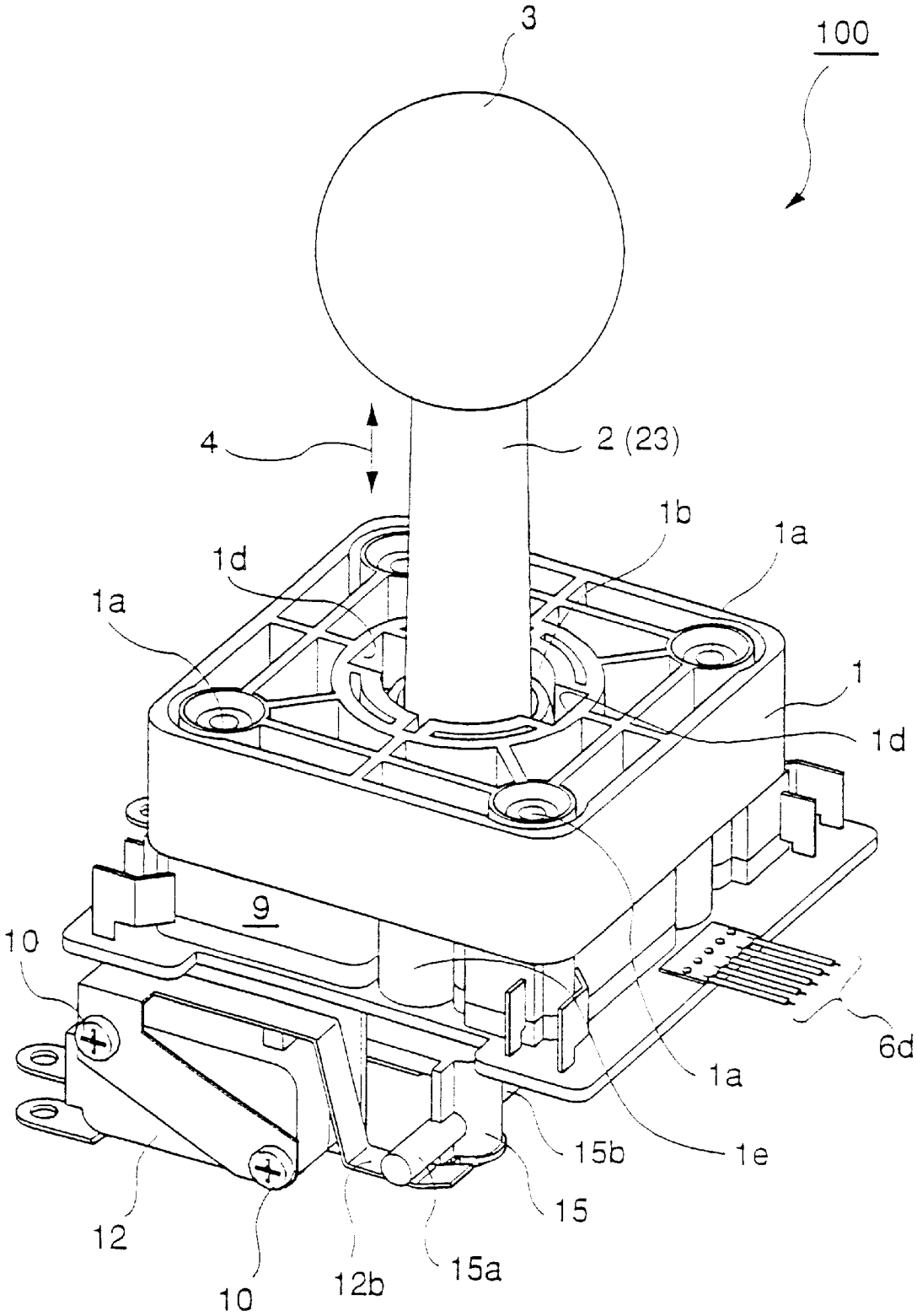
FIG. 1 is a perspective view of a first embodiment of the tiltable joystick pointing device according to the present invention.

FIG. 1 is a perspective view of a joystick pointing device embodying the present invention. This joystick pointing device 100 comprises a base 1 adapted to be attached to a frame of a video game machine or the like, typically in a horizontal orientation, and a joystick assembly 2 extending vertically from a central part of the base 1. This joystick assembly 2 is supported by the base 1 in such a manner that it can tilt in any desired horizontal direction as can be seen in most of conventionally known joystick pointing devices. The joystick assembly 2 is additionally adapted to be pulled up and pushed down by pulling and pushing at a ball knob 3 securely attached to the upper end of the stick assembly 2 as indicated by an arrow 4.

Figure 2:
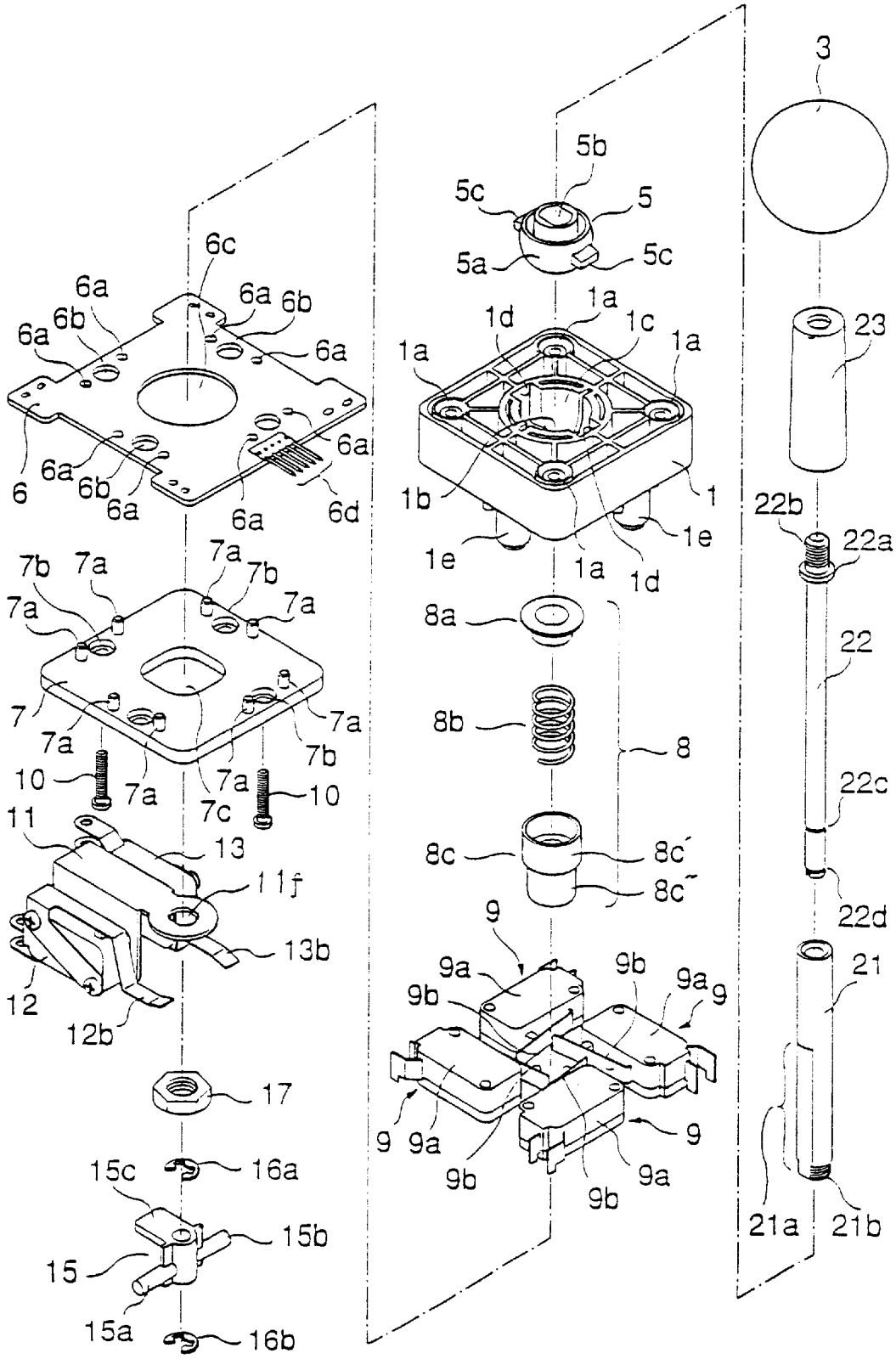
FIG. 2 is an exploded perspective view of the tiltable joystick pointing device of FIG. 1.

Referring to the exploded view of this joystick pointing device in FIG. 2, the base 1, in this case, is made of an integrally molded plastic member having a substantially rectangular shape in plan view, and is given with a prescribed height (thickness). Mounting holes la for passing mounting screws are formed on four corners of the base 1, and a large through hole 1*b* is formed in a central part thereof for receiving the lower end of the joystick assembly 2. The upper end of the through hole 1*b* is widened in a semi-spherical shape so as to serve as a seat surface 1*c* for a spherical joint which is described hereinafter. A pair of slots 1*d* are formed at diametrically opposed parts of the seat surface 1*c* for engaging corresponding projections 5*c* of a block member 5 which is described hereinafter. From the lower surface of the base 1 extend four spacer columns 1*e*.

The joystick assembly 2 comprises a first shaft 21 consisting of a straight, hollow tubular member, a second shaft 22 slidably received in the first shaft 21, and a hollow shaft cover 23 which is fitted upon an upper part of the second shaft 22. In this case, the first and second shafts 21 and 22 consist of metallic members while the shaft cover 23 consists of a mold plastic member.

The lower part of the first shaft 21 is given with a non-circular cross-section 21*a* which, in this case, is formed by forming a pair of parallel flat surfaces on diametrically opposed sides of the first shaft 21. The lower end of the first shaft 21 consists of a threaded portion 21*b* which engages a nut 17 for securing a switch holder as described hereinafter.

The outer diameter of the second shaft 22 is slightly smaller than the inner diameter of the first shaft 21, and the second shaft 22 is somewhat greater in length than the first shaft 21.The upper end of the second shaft 22 is provided with a radial flange 22*a* and a threaded portion 22*b*. The radial flange 22*a* defines the lower limit of the vertically downward movement of the stick assembly 2 by the upper end of the first shaft 21 abutting the radial flange 22*a*. The threaded portion 22*b* engages a nut 3*a* (see FIG. 6) which is insert molded in the ball knob 3. The lower end of the second shaft 22 is provided with a pair of annular grooves 22*c* and 22*d* for receiving E-rings which secure a shaft end member thereto as described hereinafter.

The shaft cover 23 consists of a slightly tapered tubular member having an inwardly directed radial flange at its upper or smaller end. The inner diameter of the shaft cover 23 is slightly larger than the outer diameter of the first shaft 21 so as to be slidable relative to each other. When this shaft cover 23 is fitted onto the first and second shafts 21 and 22, and the upper inwardly directed flange is interposed between the nut 3*a* of the ball knob 3 and the flange 22*a* of the second shaft 22, the shaft cover 23 is integrally attached to the second shaft 22. The shaft cover 23 thus has the function of improving the aesthetic external appearance of the stick assembly 2. In particular, when the second shaft 22 is pulled up by holding the ball knob 3 as described hereinafter, the shaft cover 23 hides the first shaft 21 from view, in particular the part where the second shaft 22 extends out of the upper end of the first shaft 21, and this significantly enhances the external appearance of the joystick device.

The joystick assembly 2 comprising the first shaft 21, the second shaft 22, the shaft cover 23 and the ball knob 3 is tiltably mounted to the base 1 via the block member 5 forming a part of the spherical joint. The block member 5 is provided with a semi-spherical lower surface 5*a* which is adapted to be seated on the corresponding semi-spherical seat surface 1*c* of the base 1. The block member 5 is provided with a central through hole 5*b* for receiving the non-circular cross section 21*a* of the first shaft 21, and a pair of projections 5*c* projecting from diametrically opposed positions of the outer surface thereof which are adapted to engage the corresponding stopper slots 1*d* of the base 1 for keeping the block member 5 rotationally fast with the base 1. When the block member 5 attached to the lower end of the first shaft 21 with the projections 5*c* fitted into the corresponding slots 1*d* and the semi-spherical lower surface 5*a* snugly received by the corresponding semi-spherical seat surface 1*c*, the first shaft 21 can be tilted with respect to the base 1 in any desired direction. Thus, the semi-spherical seat surface 1*c* of the base 1 and the block member 5 jointly form the spherical joint which is freely tiltable but rotationally fast around a vertical axis.

A switch mounting plate 6 and a tilt guide plate 7 are placed over the lower surface of the base 1 in a parallel relationship with a certain gap defined between them. More specifically, the switch mounting plate 6 and the tilt guide plate 7 are registered with each other with the aid of positioning holes 6*a* and positioning projections 7*a* cooperating with the positioning holes 6*a*, and are fixedly secured by passing mounting screws 10 through mounting holes 6*b* and 7*b* formed in the switching mounting plate 6 and the tilt guide plate 7, respectively.

The switch mounting plate 6 is centrally provided with a through hole 6*c* which is larger than the possible range of movement of the joystick assembly 2. The switch mounting plate 6 carries thereon a plurality (four, in this case) limit switches 9 for detecting the tilting movement of the stick assembly 2 in the respective directions. Each of the limit switches 9 comprises a micro-switch 9*a* having a pushbutton-like actuating part, and a hinged lever 9*a* for actuating the actuating part of the corresponding micro-switch 9*a*. The limit switches 9 are disposed around the central through hole 6*c* with the hinge lever 9*a* of each limit switch adjoining the central through hole 6*c*.

The tilt guide plate 7 located under the switch mounting plate 6 is centrally provided with a guide hole 7*c* which defines the possible range of movement of the joystick assembly 2. As well known in the art, depending on if the joystick pointing device is designed as a two-, four- or eight-directional, the shape of the guide hole 7*c* is appropriately selected.

In the space defined between the switch mounting plate 6 and the base 1 is accommodated a spring assembly 8 in a coaxial relationship relative to the first shaft 21. The spring assembly 8 performs the functions of actuating the limit switches 9 and providing the biasing force which urges the joystick assembly 2 towards its upright neutral position. The spring assembly 8 comprises an annular spring seat 8*a*, a coil spring 8*b*, and a spring holder 8*c* which are fitted onto the lower end of the first shaft 21 from below in that order. The spring holder 8*c* consists of a tubular member including an upper large diameter portion 8*c*' and a lower small diameter portion 8*c*". The coil spring 8*b* is received in the large diameter portion 8*c*', and is compressed between the annular shoulder defined between the two portions of the spring holder 8*c* and the spring seat 8*a*. Therefore, when the first shaft 21 is tilted in any direction by the actuation of the joystick assembly 2, the coil spring 8 is deflected radially, and applies a restoring force which urges the joystick assembly 2 towards its upright neutral position. When the coil spring 8 is thus displaced in any radial direction, the outer surface of the large diameter portion 8*c*' of the spring holder 8*c* abuts the hinged lever 9*b* of a selected one of the limit switches 9, and activates the corresponding micro-switch 9*a*.

Figure 3:
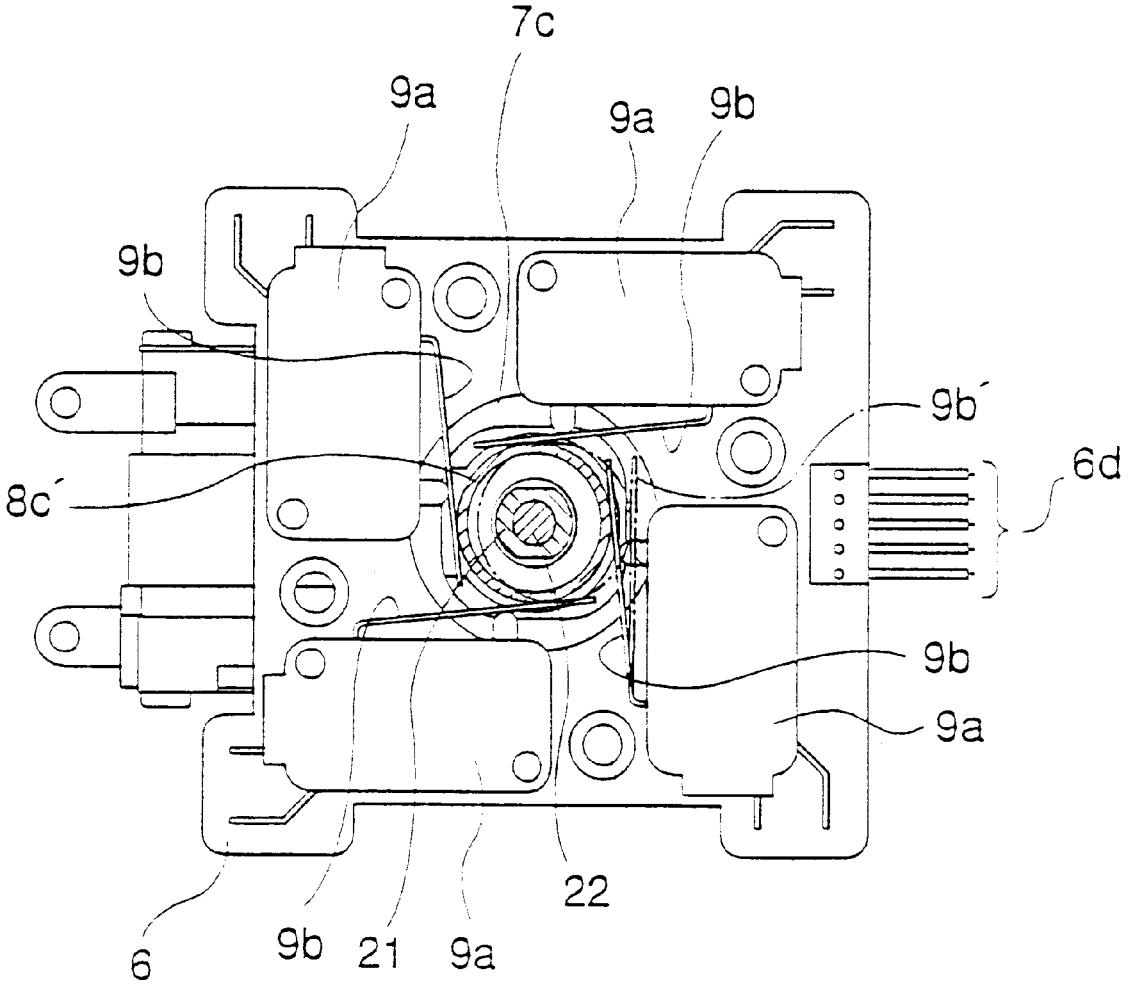
FIG. 3 is a sectional plan view of the tiltable joystick pointing device of FIG. 1.

More specifically, referring to FIG. 3, as the large diameter portion 8*c*' of the spring holder 8 fitted upon the first shaft 21 moves in the guide holder 7*c* following the movement of the joystick assembly 2, the corresponding hinged lever 7*c* is deflected as shown by the imaginary lines 9*b*' in the drawing, and the corresponding micro-switch 9*a* is activated. As a result, in the illustrated embodiment, a selected one of the micro-switches is activated when the joystick assembly 2 is tilted in the forward, rearward, right or left direction, but, when the stick assembly 2 is tilted in an oblique direction, the two micro-switches on either side of the tilting direction are activated. Therefore, a four-bit signal indicating the tilting direction is obtained from these micro-switches via a connector pin array 6*d*. The micro-switches, in this case, are directly mounted on the switch mounting plate 6, and the output signal therefrom is forwarded to the connector pin array 6*d* via an electroconductive circuit pattern (not shown in the drawing) formed on the switch mounting plate 6.

Figure 4:
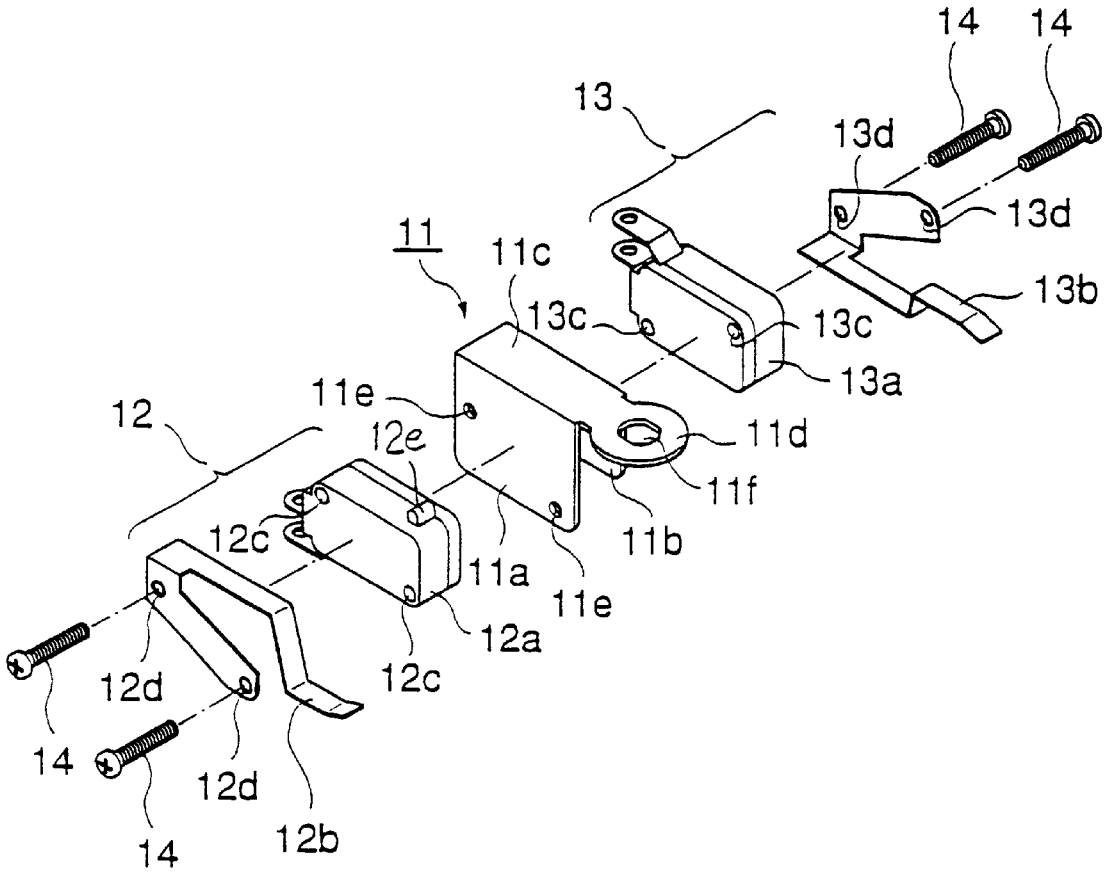
FIG. 4 is an exploded perspective view of the sliding direction detector of the tiltable joystick pointing device of FIG. 1.

Now is described the sliding direction detecting mechanism for detecting the axial pushing and pulling movement of the ball knob 3. To the lower end of the first shaft 21 is attached a pair of limit switches 12 and 13 via a switch holder 11. As best shown in FIG. 4, the switch holder 11, which in this case consists of a metallic member, comprises right and left vertical mounting plates 11*a* and 11*b*, a horizontal connecting plate 11*c* connecting the upper ends of the vertical mounting plates to each other, and a tongue piece lid extending from the horizontal connecting plate 11*c* and provided with a mounting hole 11*f* for passing a mounting screw. Numeral 11*e* denotes threaded holes for receiving screws which securely attach the micro-switches to the corresponding vertical mounting plates 11*a* and 11*b*. The switch holder 11 is attached to the lower end of the first shaft 21 by passing the threaded portion 21*b* of the first shaft 21 into the mounting hole 11*f* of the tongue piece 11, and fastening the nut 17 onto the threaded portion 21*b*. The limit switches 12 and 13 each comprise a micro-switch 12*a* or 13*a*, and a hinged lever 12*b* or 13*b* made of spring material. Numerals 11*e*, 12*c*, 12*d*, 13*c* and 13*d* denote mounting holes for passing mounting screws 14. These limit switches 12 and 13 are mounted on the vertical mounting plates 11*a* and 11*b* of the switch holder 11 in a mutually inverted relationship, and are fixedly secured by fastening the screws 14 passed through the mounting holes 12*d*, 12*c*, 13*d* and 13*c* and threaded into the threaded holes 11*e* of the vertical mounting plates 11*a* and 11*b*. Thus, the restoring force acting on the hinged lever 12*b* of the limit switch 12 is directed upward while the restoring force acting on the hinged lever 13*b* of the limit switch 13 is directed downward. Numeral 12*e* denotes the pushbutton-like actuating parts of the micro-switches.

The shaft end member 15 serving as the operating member for the two limit switches 12 and 13 is fitted onto the lower end of the second shaft 22, and is fixedly secured thereto by a pair of E-rings 16*a* and 16*b*. The shaft end member 15 defines the upper limit of the axially upward movement of the second shaft 22 by abutting the lower end surface of the first shaft 21. The shaft end member 15 comprises a pair of actuating projections 15*a* and 15*b* which alternatingly engage the hinged levers 12*b* and 13*b* of the limit switches 12*a* and 13*a*, and the horizontal stopper arm 15*c* which is fitted into the gap between the vertical mounting plates 11*a* and 11*b* of the switch holder 11 to keep the shaft end member 15 rotationally fast with respect to the base 1.

Figure 5A:
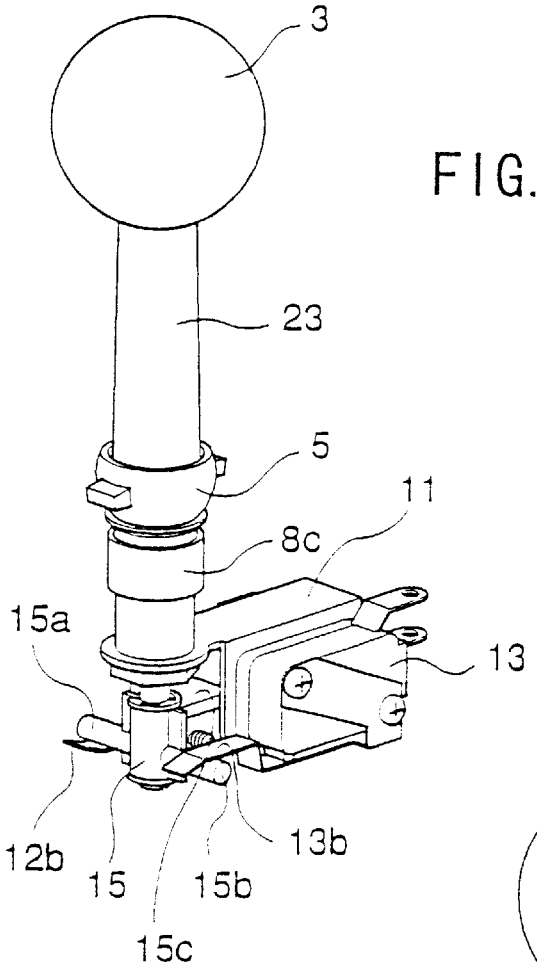
FIGS. 5(*a*) and 5(*b*) are perspective views of the sliding direction detector of FIG. 4 as seen from different angles.
Figure 5B:
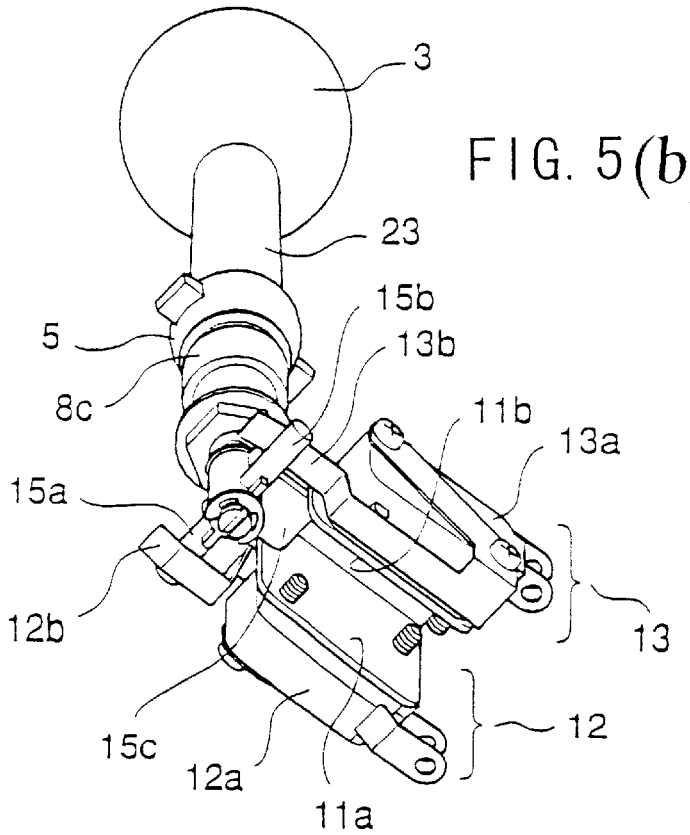

FIG. 5 illustrates the manner of engagement between the actuating projections 15*a* and 15*b* and the hinged levers 12*b* and 13*b*, and between the horizontal stopper arm 15*c* and the vertical mounting plates 11*a* and 11*b*. As clearly shown in FIGS. 5(*a*) and 5(*b*), the left hinged lever 12*b* abuts the left actuating projection 15*a* while the right hinged lever 13*b* abuts the right actuating projection 15*b* in an alternating manner. Therefore, when the second shaft 22 is pushed down, and slidingly moves downward inside the first shaft 21, the left hinged lever 12*b* deflects downward, and activates the micro-switch 12*a*. Conversely, when the second shaft 22 is pulled up, and slidingly moves upward inside the first shaft 21, the right hinged lever 13*b* deflects upward, and activates the micro-switch 13*a*. When the second shaft 21 is not subjected to any vertical force, and is therefore left free, the second shaft 22 is kept stationary at a neutral position where the upward restoring force of the left hinged lever 12*b* balances out with the downward restoring force of the right hinged lever 13*b*. In other words, the right and left limit switches 12 and 13 jointly form a sliding direction detector, and indicate by a binary signal the occurrence of an axial sliding movement of the second shaft 22 with respect to the first shaft 21 which exceeds a certain negative or positive (upward or downward) reference stroke from the neutral position.

Because the stopper arm 15*c* extending from the shaft end member 15 is fitted in the gap between the right and left vertical mounting plates 11*a* and 11*b*, even when the second shaft 22 is vertically moved and turned, the relative positioning between the right and left hinged levers 12*b* and 13*b* and the right and left actuating projections 15*a* and 15*b* remains fixed. In other words, even when the joystick assembly 2 is vigorously moved either laterally or in the fore-and-aft direction, a signal indicating the vertical movement of the joystick assembly 2 can be generated in a both accurate and reliable manner.

Figure 6:
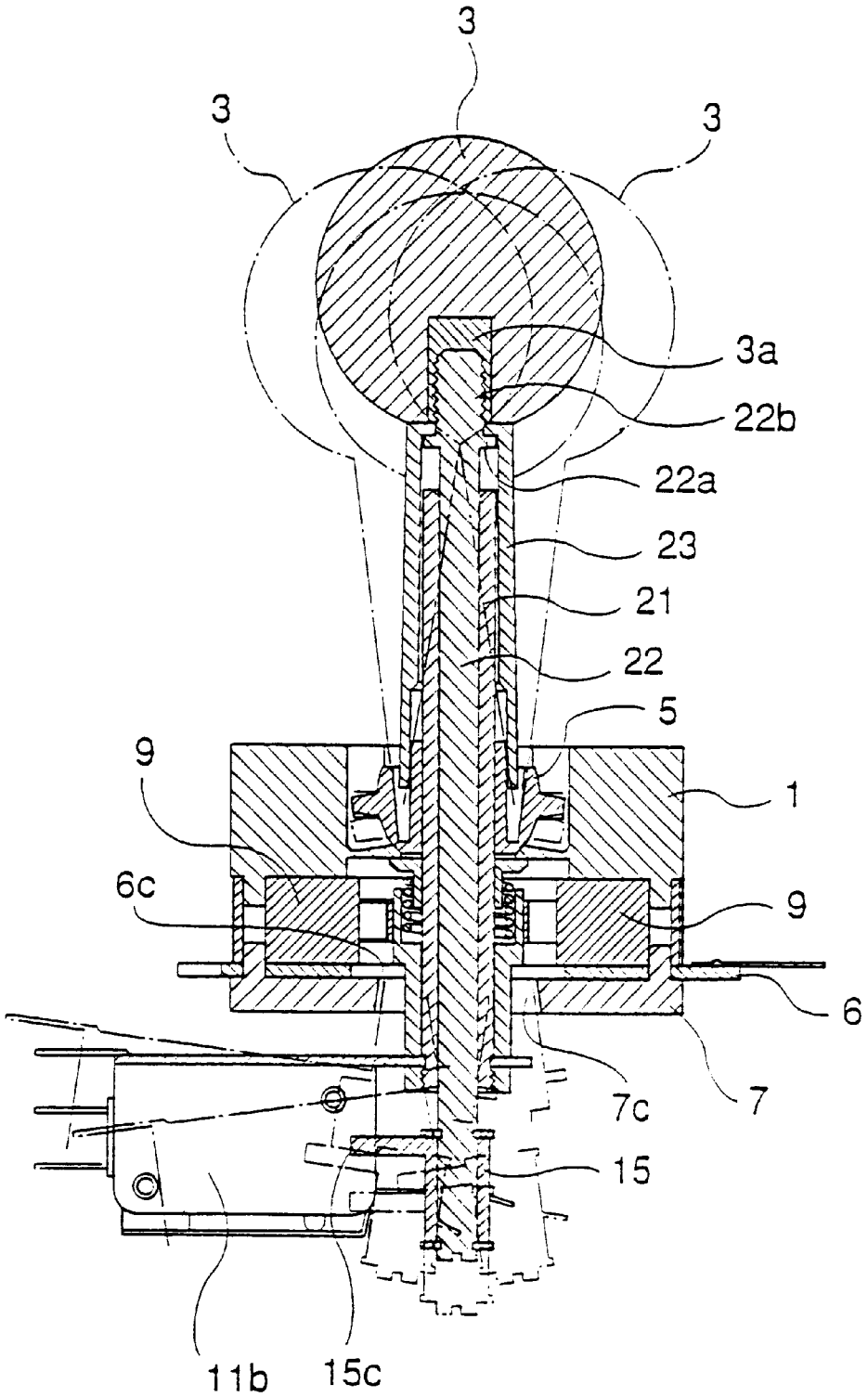
FIG. 6 is a sectional side view of the tiltable joystick pointing device of FIG. 1.

FIG. 6 illustrates the mode of operation of the joystick pointing device of the present invention with a cross sectional view. Referring to FIG. 6, when the joystick assembly 2 is tilted in any direction by holding the ball knob 3 as indicated by the imaginary lines, the first shaft 21 tilts in a conventional manner. The tilting movement of the first shaft 21 (in the forward, rearward, right, left or any one of possible oblique directions) causes a selected one of the limit switches or selected two of the limit switches to be activated, and a corresponding four-bit detector signal is produced from the connector pin array 6*d*. This detector signal is then processed in a conventional manner, and causes an object displayed on the display device to move in a prescribed direction. When the joystick assembly 2 is pushed down or pulled up by holding the ball knob 3, the first shaft 21 remains stationary, but the second shaft 22 moves axially inside the first shaft 21. This in turn causes one of the two limit switches of the slide direction detector to be activated, and a corresponding binary signal is produced from the micro-switches 12*a* and 13*a* of the limit switches 12 and 13. This signal is processed in a conventional manner, and produces a prescribed change in the object displayed on the display device. Thus, by combining the signal obtained by tilting the joystick assembly and the signal obtained by axially pulling or pushing the ball knob, a signal of a wider range of contents can be obtained.

Now a second embodiment of the tiltable joystick pointing device according to the present invention is described in the following with reference to FIGS. 7 to 12. This embodiment differs from the previous embodiment in the following respects.

(1) A dedicated spring is used for producing the axial urging force instead of relying on the hinged levers of the limit switches.

(2) The switch holder is shaped symmetric around the axial center of the first and second shafts so that the entire assembly can be made highly compact and the insertion of the assembly into a mounting hole of the frame of the game machine is made simple.

(3) The circuit board for leading the signal from the micro-switches consists of a square annular plate member, and the central opening of the circuit board is made larger than the outer profile of the mounting base and the tilt guide plate so that the circuit board can be fitted onto them, thereby allowing the assembling and soldering of the circuit board to be performed in the last stage of the assembly work.

Figure 7:
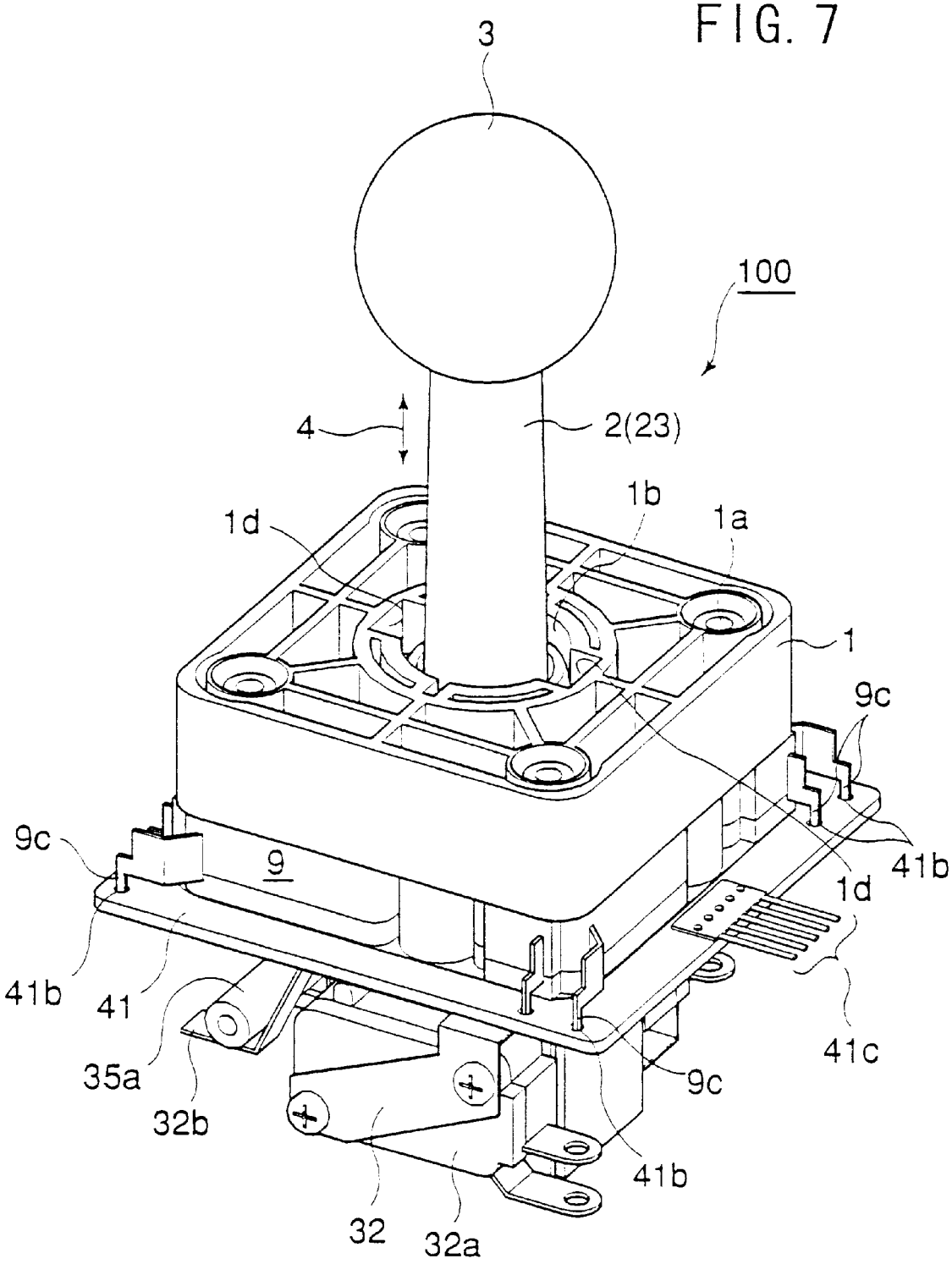
FIG. 7 is a perspective view of a second embodiment of the tiltable joystick pointing device according to the present invention.
Figure 8:
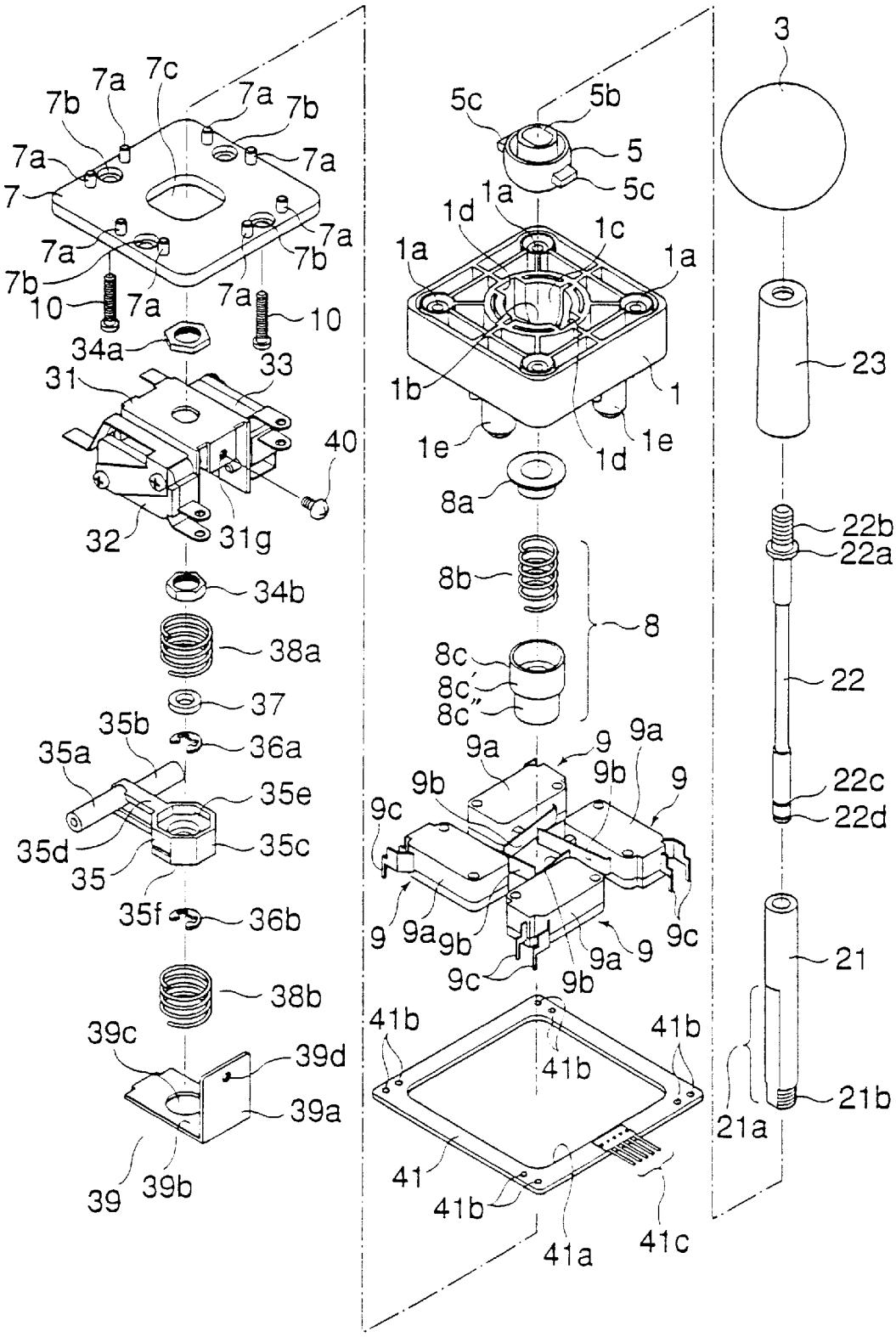
FIG. 8 is an exploded perspective view of the tiltable joystick pointing device of FIG. 7.
Figure 9:
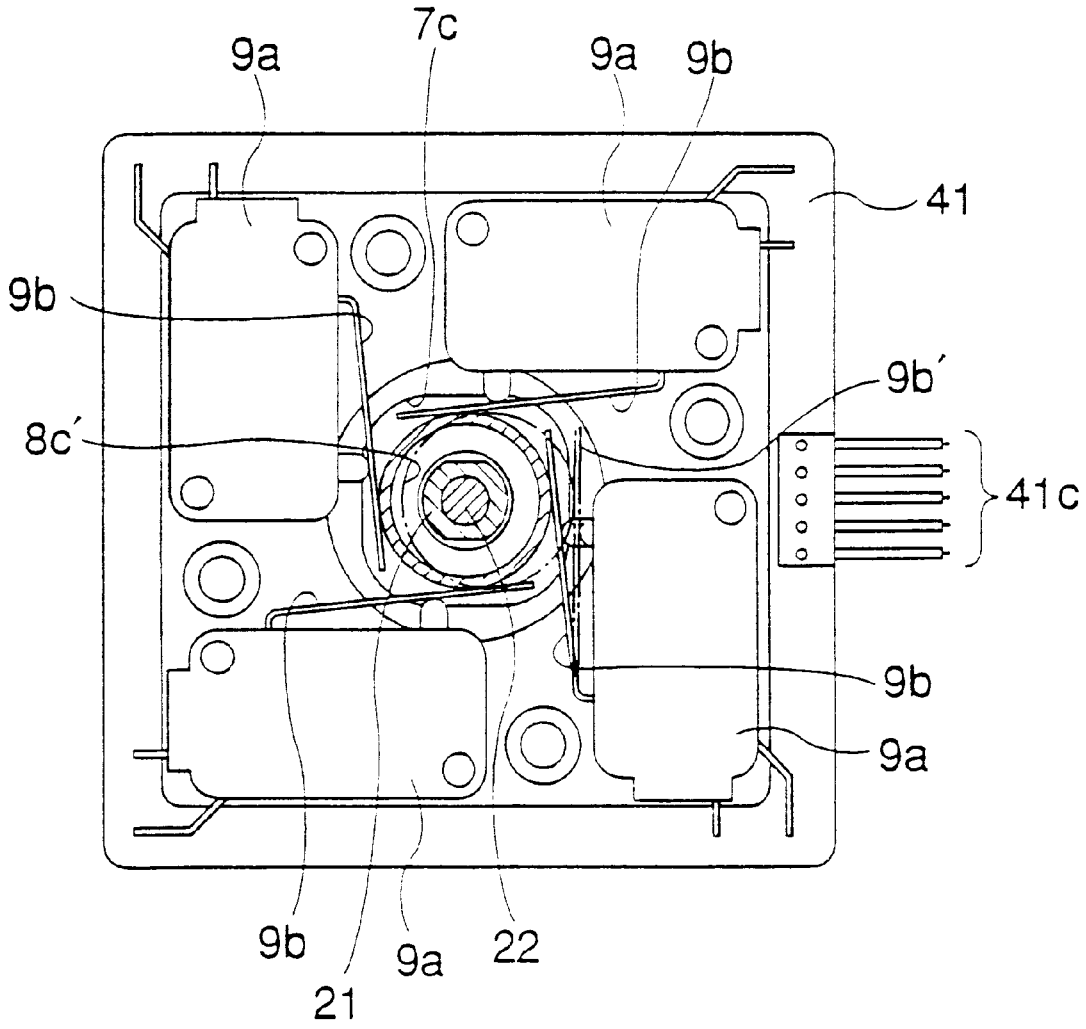
FIG. 9 is a sectional plan view of the tiltable joystick pointing device of FIG. 7.
Figure 10:
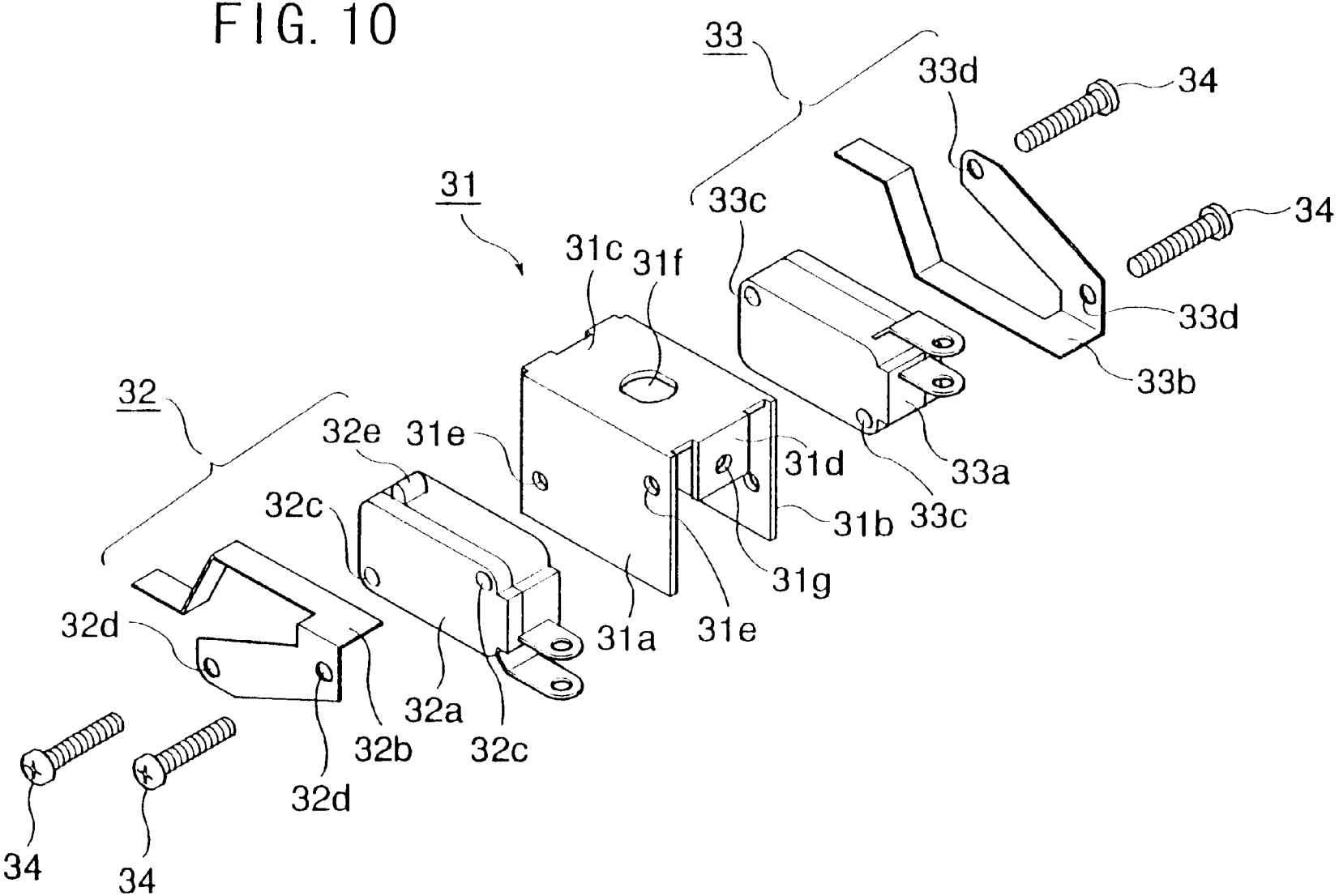
FIG. 10 is an exploded perspective view of the sliding direction detector of the tiltable joystick pointing device of FIG. 7.
Figure 11A:
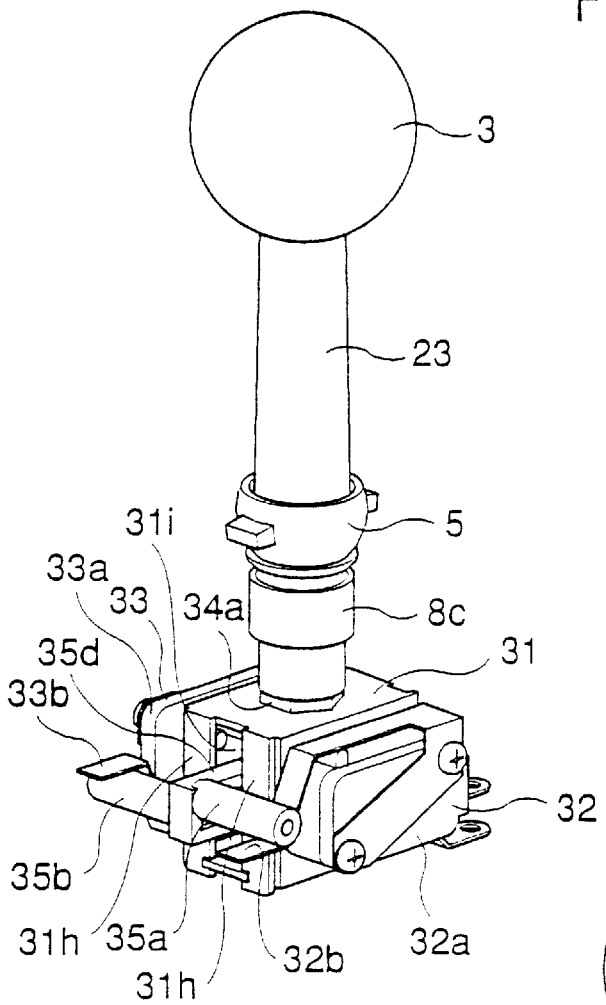
FIGS. 11(*a*) and 11(*b*) are perspective views of the sliding direction detector of FIG. 10 as seen from different angles.
Figure 11B:
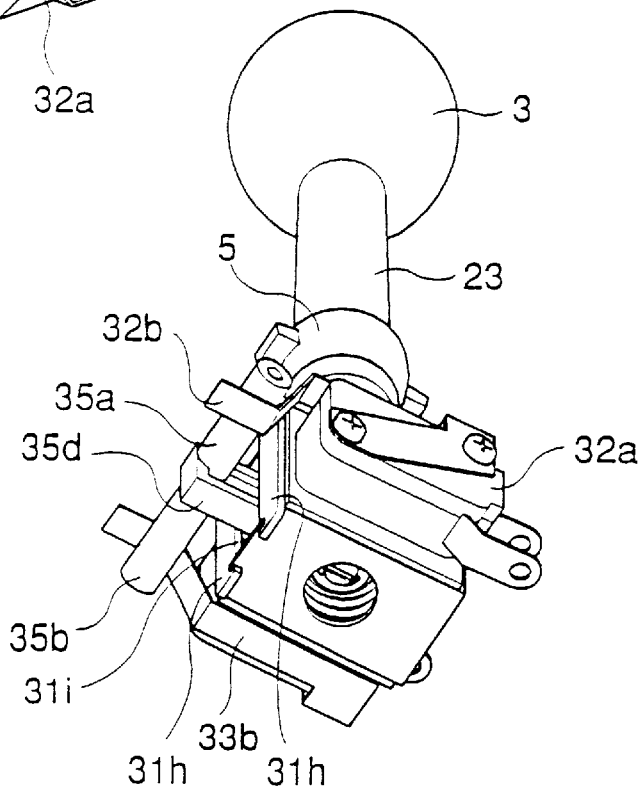
Figure 12:
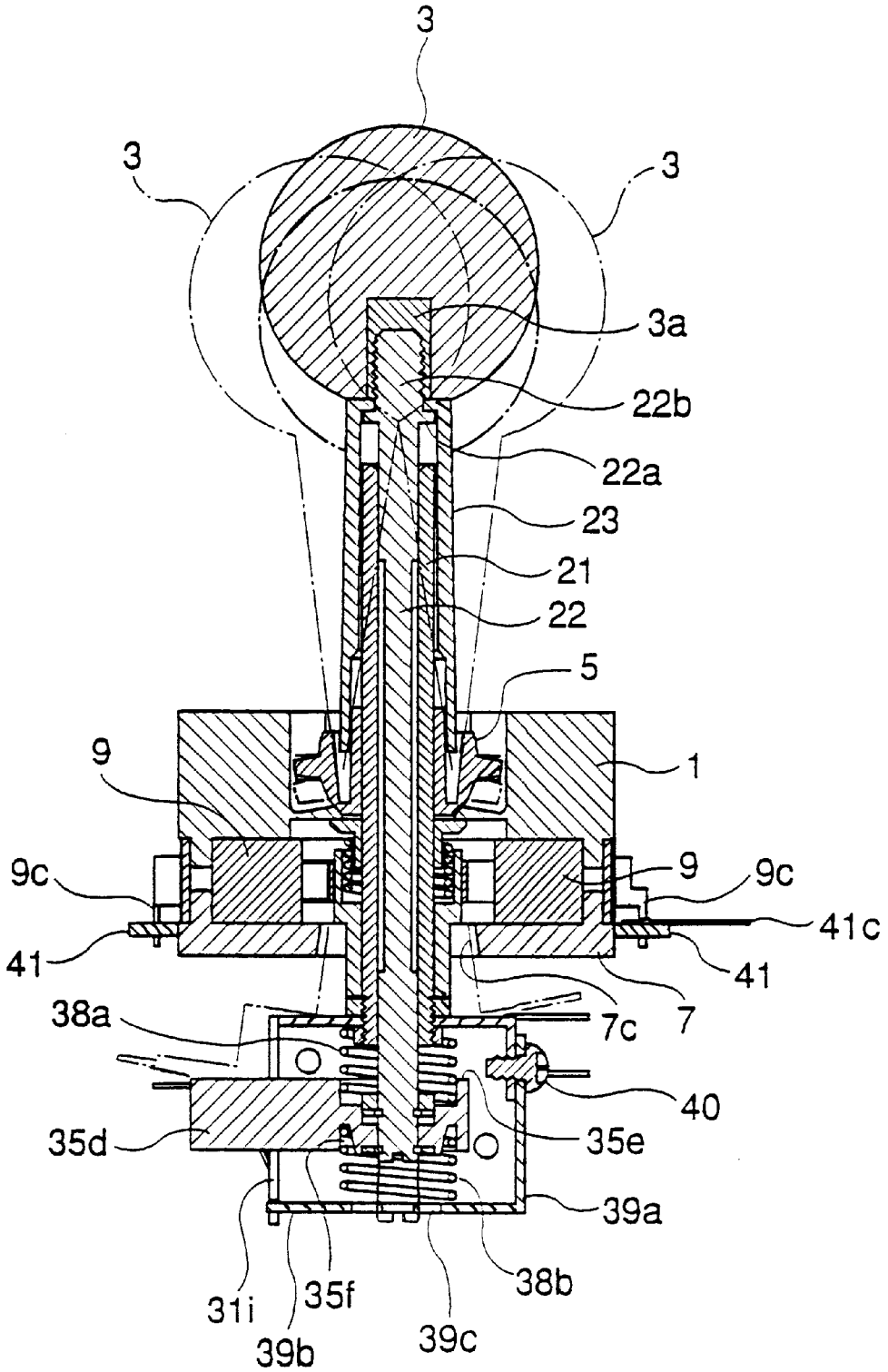
FIG. 12 is a sectional side view of the tiltable joystick pointing device of FIG. 7.

FIG. 7 is a perspective view showing the assembled state of the tiltable joystick pointing device given as the second embodiment of the present invention, FIG. 8 is an exploded perspective view showing the component parts and the assembled state of the tiltable joystick pointing device, FIG. 9 is a sectional plan view showing the structure of the tilt direction detector of the tiltable joystick pointing device, FIG. 10 is an exploded perspective view of the components associated with the two limit switches of the slide direction detector of the tiltable joystick pointing device, showing how they are assembled, FIGS. 11(*a*) and 11(*b*) are perspective views from different angles, illustrating the structure of the slide direction detector of the tiltable joystick pointing device, and FIG. 12 is a sectional view showing the operation of the tiltable joystick pointing device when the joystick member is pushed down and is tilted in a certain direction. In these drawings, the parts corresponding to those of the first embodiment illustrated in FIGS. 1 to 6 are denoted with like numerals.

The tiltable joystick pointing device of the second embodiment is similar to that of the first embodiment in the following respects; (1) the structure of the joystick assembly comprising the first shaft 21, the second shaft 22, the shaft cover 23 and the ball knob 3, (2) the structure for pivotally supporting this joystick assembly on the base 1 via a block member 5, (3) the structure of the spring assembly for urging the joystick assembly into the upright position, (4) the structure of the limit switches 9 forming the tilt direction detector, and (5) the structure of the tilt guide plate for guiding the tilting movement of the joystick assembly.

On the other hand, the slide direction detector for detecting the pushdown and pull-up movement of the second embodiment is substantially different from that of the first embodiment. More specifically, referring to FIG. 8, To the lower end of the first shaft 21 are fixedly secured a pair of limit switches 32 and 33 via a switch holder 31. The switch holder 31, which in this case consists of a metallic member, comprises a pair of laterally opposing vertical mounting plates 31*a* and 31*b*, a horizontal connecting plate 31*c* connecting the upper ends of the vertical mounting plates 31*a* and 31*b* to each other and having a central mounting hole 31*f*, a tongue piece 31*d* depending from the front end of the horizontal connecting plate 31*c* and having a threaded mounting hole 31*g* for receiving a mounting screw, and a pair of vertical guide plates 31*h* depending from the rear end of the horizontal connecting plate 31*c* (see FIGS. 11(*a*) and 11(*b*)). The rear vertical guide plates 31*h* define a vertically extending guide slot 31*i* therebetween. Numeral 31*e* denotes threaded holes for receiving screws for securing the microswitches. The switch holder 31 is fixedly secured to the lower end of the first shaft 21 by inserting the threaded portion 21*b* in the lower end of the first shaft 21 into the mounting hole 31*f* of the horizontal connecting plate 31*c* with the nut 34*a* threaded thereon in advance, and then engaging and firmly fastening another nut 34*b* on the threaded portion 21*b* with the horizontal connecting plate 31*c* of the switch holder 31 clamped between the two nuts 34*a* and 34*b*. As can be appreciated by comparing FIG. 10 with FIG. 4, the mounting hole 31*f* is located in a central part of the horizontal connecting plate 31*c*. Therefore, the two limit switches 32 and 33 can be arranged around the axial center of the joystick assembly 2 in a symmetric and compact manner without any part thereof protruding in a radial direction as was the case with the first embodiment shown in FIG. 4. Therefore, fitting the device into a mounting hole of the frame of the game machine is made both smooth and simple.

The limit switches 32 and 33 each consist of a microswitch 32*a* or 33*a* and a hinged lever 32*b* or 33*b* made of spring material. Numerals 32*c*, 32*d*, 33*c* and 33*d* denote holes for receiving mounting screws 34. These limit switches 32 and 33 are mounted on the vertical mounting plates 31*a* and 31*b* of the switch holder 31 in a mutually inverted relationship, and are fixedly secured by fastening the screws 34 passed through the mounting holes 32*d*, 32*c*, 33*d* and 33*c* and threaded into the threaded holes 31*e* of the vertical mounting plates 31*a* and 31*b*. Thus, the restoring force acting on the hinged lever 32*b* of the limit switch 32 is directed upward while the restoring force acting on the hinged lever 33*b* of the limit switch 33 is directed downward. Numeral 32*e* denotes the pushbutton-like actuating part of the limit switch 32.

The shaft end member 35 serving as the operating member for the two limit switches 32 and 33 is fitted onto the lower end of the second shaft 22, and is fixedly secured by a pair of E-rings 36*a* and 36*b*. The shaft end member 35 defines the upper limit of the axially upward movement of the second shaft 22 by abutting the lower end surface of the first shaft 21 via a rubber cushion ring 37. The shaft end member 35 comprises an annular part 35*c* receiving the lower end of the second shaft 22, a horizontal stopper arm 35*d* extending horizontally from the annular part 35*c*, a pair of actuating projections 35*a* and 35*b* extending laterally from the free end of the stopper arm 35*d* and alternatingly engage the hinged levers 32*b* and 33*b* of the limit switches 32 and 33.

FIGS. 11(*a*) and 11(*b*) illustrate the mode of engagement between the actuating projections 35*a* and 35*b* and the corresponding hinged levers 32*b* and 33*b*, and the relationship between the stopper arm 35*d* and the guide slot 31*i* of the vertical guide plates 31*h*. As can be readily appreciated from this drawing, the left hinged lever 32*b* abuts the actuating projecting 35*a* from below while the right hinged lever 33*b* abuts the actuating part 35*b* from above. Therefore, as the second shaft 22 is pushed down, and slides downward inside the first shaft 21, the left hinged lever 32*b* deflects downward and activates the corresponding microswitch 32*a*. Conversely, as the second shaft 22 is pulled up, and slides upward inside the first shaft 21, the right hinged lever 33*b* deflects upward and activates the corresponding micro-switch 33*a*. Because the stopper arm 35*d* of the shaft end member 35 is received in the guide slot 31*i* defined between the vertical guide plates 31*h*, the vertical and rotational movements of the second shaft 22 inside the first shaft 21 would not cause any change in the relative positions between the right and left hinged levers 32*b* and 33*b* and the right and left actuating projections 35*a* and 35*b*. In other words, even when the joystick assembly is vigorously moved laterally in any direction, the push-down and pull-up movement of the joystick assembly can produce a corresponding vertical direction signal in a both accurate and reliable manner.

Now is described the dedicated spring assembly which applies a biasing force which urges the joystick assembly toward the axially neutral position, in addition to the biasing forces of the hinged levers 32*b* and 33*b*. The upper end surface of the annular part 35*c* of the shaft end member 35 is provided with an annular recess 35*e* serving as a seat for an upper spring 38*a*, and the lower end surface of the annular part 35*c* of the shaft end member 35 is provided with an annular slot 35*f* for receiving an upper end of a lower spring 38*b*. The upper spring 38*a* is fitted around the first shaft 21 and interposed between the annular recess 35*e* on the upper end surface of the annular part 35*c* of the shaft end member 35 and the lower surface of the horizontal connecting plate 31*c* of the switch holder 31 (see FIG. 12). An L-shaped spring retaining member 39 is fixedly secured to the switch holder 31. The L-shaped spring retaining member 39 comprises a vertical section 39*a* and a horizontal section 39*b*, and the horizontal section 39*b* is centrally provided with a circular hole 39*c* to avoid the interference with the movement of the lower end of the second shaft 22. The spring holder 31 is fixedly secured to the L-shaped spring retaining member 39 by registering the mounting hole 31*g* of the tongue piece 31*d* of the switch holder 31 with a mounting hole 39*d* formed in the vertical section 39*a* of the spring retaining member 39, and fastening the screw 40 passed through these holes. The lower coil spring 38*b* is disposed coaxially with respect to the second shaft 22 and interposed between the annular groove 35*f* in the lower end of the annular part 35*c* of the shaft end member 35 and the spring retaining member 39 (see FIG. 12). The spring forces of these compression coil springs 38*a* and 38*b* are selected in such a manner that the shaft end member 35 is balanced at a vertically neutral position which activates neither one of the limit switches 32 and 33. Therefore, when the second shaft 22 is pulled up, and the limit switch 33 is activated, the upper coil spring 38*a* is compressed and urges the second shaft 22 downward. Conversely, when the second shaft 22 is pushed down, and the limit switch 32 is activated, the lower coil spring 38*b* is compressed, and urges the second shaft 22 upward.

Now is described the circuit board which includes a circuit pattern for collecting signals from the individual limit switches 9, and leading out the combined signal to the outside. In the first embodiment, the switch mounting plate 6 was used as the circuit board for leading the combined signal from the limit switches 9. The micro-switches 9*a* of the limit switches 9 were mounted on the switch mounting plate 6, and the terminal pins extending from the micro-switches 9*a* were soldered to the appropriate pads of the circuit pattern on the switch mounting plate 6. The need for such a soldering step preceding the final assembly process is not desirable in view of the assembling cost. The second embodiment eliminates such a problem.

The circuit board 41 of the second embodiment is illustrated in FIG. 8. As shown in this drawing, this circuit board 41 has a square and annular shape, and the central opening 41*a* thereof is substantially conformal to (or slightly larger than) the outer profile of the base 1 and the tilt guide plate 7. The corners of the central opening 41*a* are appropriately rounded as desired. A pair of pin insertion holes 41*b* are formed on each corner of the circuit board 41 for receiving terminal pins 9*c* of the corresponding micro-switch 9*a*. These pin insertion holes 41*b* are located so as to coincide with the terminal pins 9*c* of the micro-switches 9*a* when they are located on the tilt guide plate 7 with the aid of the positioning projections 7*a* thereof. The circuit board 41 carries a circuit pattern (not shown in the drawings) for leading the signals from the micro-switches 9*a* to the connector pin array 41*c* mounted on the circuit board 41. The use of this circuit board 41 allows the step of soldering the terminal pins 9*c* of the micro-switches to the circuit pattern on the circuit board 41 to the performed in the last stage of the assembly process. More specifically, the limit switches 9 are fixedly secured between the base 1 and the tilt guide plate 7, and the joystick assembly (21, 22, 23 and 3) is passed through the base 1 via the block member 5. The spring assembly 8, the switch holder 31, the limit switches 32 and 33, and the shaft end member 15 are assembled. Thereafter, the circuit board 41 is fitted on the joystick assembly. The terminal pins 9*c* of the micro-switches 9*a* are fitted into the pin insertion holes 41*b*, and the terminal pins 9*c* are then soldered to the circuit pattern not shown in the drawings.

The mode of operation of this tiltable joystick pointing device is illustrated in the sectional view of FIG. 12. As can be readily appreciated from this drawing, when the ball knob 3 is held, and the joystick assembly 2 is tilted as indicated by the imaginary lines in the drawing, the first shaft 21 tilts in a known manner, and the resulting activation of the limit switches 9 of the tilt direction detector produces a four-bit tilt direction signal from the connector pin array 41*c*. The tilt direction signal is processed in a known manner, and causes a corresponding movement of an object on the display device. When the ball knob 3 is held and either pushed down or pulled up, the second shaft 22 moves axially with respect to the first shaft 21 which remains stationary in the axial direction. This causes either one of the two limit switches 32 and 33 of the slide direction detector to be activated. A binary signal is produced from the terminals of the micro-switches 32*a* and 33*a* of the limit switches 32 and 33 to indicate the occurrence of a pull-up or push-down movement of the ball knob 3. The binary signal is processed in a known manner, and causes a prescribed change or movement of an object on the display device. In other words, the single joystick assembly allows both the tilt direction signal and the slide direction signal to be produced in any combination all by itself. In other words, the tiltable joystick pointing device of the present invention is capable of producing a signal of more diverse contents than was possible with the conventional joystick pointing device.

Although the present invention has been described in terms of preferred embodiments thereof, it is obvious to a person skilled in the art that various alterations and modifications are possible without departing from the scope of the present invention which is set forth in the appended claims.

What is claimed is:

1. A tiltable joystick device, comprising:

a joystick assembly pivotally supported by a base;

a first spring assembly for urging said joystick assembly toward an upright neutral position;

a tilt direction detector for producing a tilt direction signal corresponding to a tilt direction of said joystick assembly;

wherein:

said joystick assembly comprises a first shaft having a main longitudinal axis, said first shaft being pivotally supported by said base and urged by said first spring assembly into said upright neutral position, a second shaft slidably guided relative to said first shaft so as to be slidable along said main longitudinal axis of said first shaft, a second spring assembly for axially urging said second shaft toward an axially neutral position, and a slide direction detector for producing a slide direction signal corresponding to an axial movement of said second shaft.

2. A tiltable joystick pointing device according to claim 1, wherein said second shaft is provided with an upper end extending out of an upper end of said first shaft, and fitted with a knob.

3. A tiltable joystick pointing device according to claim 2, wherein said first shaft comprises a hollow tubular member, and said second shaft is slidably received inside said first shaft.

4. A tiltable joystick pointing device according to claim 3, further comprising a tubular shaft cover coaxially attached to said second shaft to cover at least an upper end of said first shaft.

5. A tiltable joystick pointing device according to claim 3, wherein said slide direction detector comprises a switch holder attached to a lower end of said first shaft, a switch element mounted on said switch holder, and a shaft end member attached to a lower end of said second shaft, said shaft end member being provided with an actuating projection with engages an actuating part of said switch element in response to an axial movement of said second shaft relative to said first shaft.

6. A tiltable joystick pointing device according to claim 5, wherein said shaft end member further comprises a stopper arm extending therefrom which is engaged by a vertical guide slot defined in said switch holder for maintaining said second shaft rotationally fast with respect to said first shaft around an axial line thereof.

7. A tiltable joystick pointing device according to claim 5, wherein said slide direction detector further comprises an upper spring member compressed between said switch holder and an upper end of said shaft end member so as to urge said second shaft downward with respect to the first shaft, and a lower spring member compressed between a lower end surface of said shaft member and a spring retaining member extending integrally from said switch holder so as to urge said second shaft upward with respect to said first shaft, said second shaft being balanced at a axially neutral position under spring forces of said upper and lower springs.

8. A tiltable joystick pointing device according to claim 1, wherein said slide direction detector is adapted to produce a slide direction signal when an axial movement of said second shaft relative to said first shaft exceeds a prescribed stroke in either axial slide direction.

9. A tiltable joystick pointing device according to claim 1, wherein said tilt direction detector comprises a plurality of switch elements mounted on a switch mounting plate which is interposed between a lower end of said base and a tilt guide plate.

10. A tiltable joystick pointing device according to claim 1, wherein said tilt direction detector comprises a plurality of switch elements mounted on a tilt guide plate attached to a lower end of said base, and an annular circuit board surrounding said tilt guide plate and having holes for receiving terminal pins extending from said switch elements.

11. A tiltable joystick pointing device according to claim 1, wherein the slide direction detector produces a slide direction signal corresponding to an axial movement of said second shaft in a pushing direction.

12. A tiltable joystick pointing device according to claim 1, wherein the slide direction detector produces a slide direction signal corresponding to an axial movement of said second shaft in a pulling direction.

* * * * *